US005742940A

United States Patent [19]

Sparks

[11] Patent Number: 5,742,940

[45] Date of Patent: Apr. 28, 1998

[54] GARMENT INCLUDING A POCKET FOR HOLDING READING MATERIAL

[76] Inventor: Katrina Sparks, 621 20th St., Richmond, Calif. 94801

[21] Appl. No.: 532,066

[22] Filed: Sep. 21, 1995

[51] Int. Cl.[6] ..... A41D 1/06

[52] U.S. Cl. ..... 2/79; 2/227; 2/69; 40/586

[58] Field of Search ..... 2/79, 80, 227, 2/228, 238, 69, 115, 108, 102, 94, 246, 244, 247, 250, 220, 221, 241; 40/586, 299

[56] References Cited

U.S. PATENT DOCUMENTS

| | | | |
|---|---|---|---|
| 3,055,133 | 9/1962 | Anderson | 2/102 |
| 3,193,842 | 7/1965 | Bell | 2/94 |
| 3,582,993 | 6/1971 | Keller | 40/586 |
| 4,625,337 | 12/1986 | Zahn | 2/94 |
| 4,650,219 | 3/1987 | Sigman | 40/586 |
| 4,924,613 | 5/1990 | Levin | 40/586 |
| 5,173,968 | 12/1992 | Fox | 2/108 |
| 5,421,032 | 6/1995 | Murphy | 2/247 |

*Primary Examiner*—Gloria Hale
*Attorney, Agent, or Firm*—Sawyer & Associates

[57] ABSTRACT

A garment for holding reading material includes a pocket member. The garment also includes an attachment portion which attaches to the pocket member for retaining the reading material to the pocket member. In a first aspect, the attachment portion is a string attached to a cover portion which covers a book. In a second aspect, a back cover of a book is sewn onto the garment.

9 Claims, 7 Drawing Sheets

GARMENT INCLUDING A POCKET FOR HOLDING READING MATERIAL

FIELD OF THE INVENTION

The present invention relates to garments and more particularly to garments that can include a book or other similar type of reading material.

BACKGROUND OF THE INVENTION

Children's garments are worn in a variety of manners. In such a garment, oftentimes the pockets are too small to hold books or other reading material that a child may use. This becomes problematic when the child loses the books because they have laid the book down and then forget to pick up the book again. Clearly, what is needed therefore is a system and method on a garment for allowing a child to retain reading material but at the same time make it easily accessible to the child when it is time to review such material. The present invention addresses such a need.

SUMMARY OF THE INVENTION

A garment for holding reading material includes a pocket member. The garment also includes an attachment portion which attaches to the pocket member for retaining the reading material to the pocket member. In a first aspect, the attachment portion is a string attached to a cover portion which covers a book. In a second aspect, a back cover of a book is sewn onto the garment.

DETAILED DESCRIPTION

The present invention is an improvement in a garment for children. The following description is presented to enable one of ordinary skill in the art to make and use the invention and is provided in the context of a patent application and its requirements. Various modifications to the preferred embodiment and the generic principles and features described herein will be readily apparent to those skilled in the art.

Figure 1:
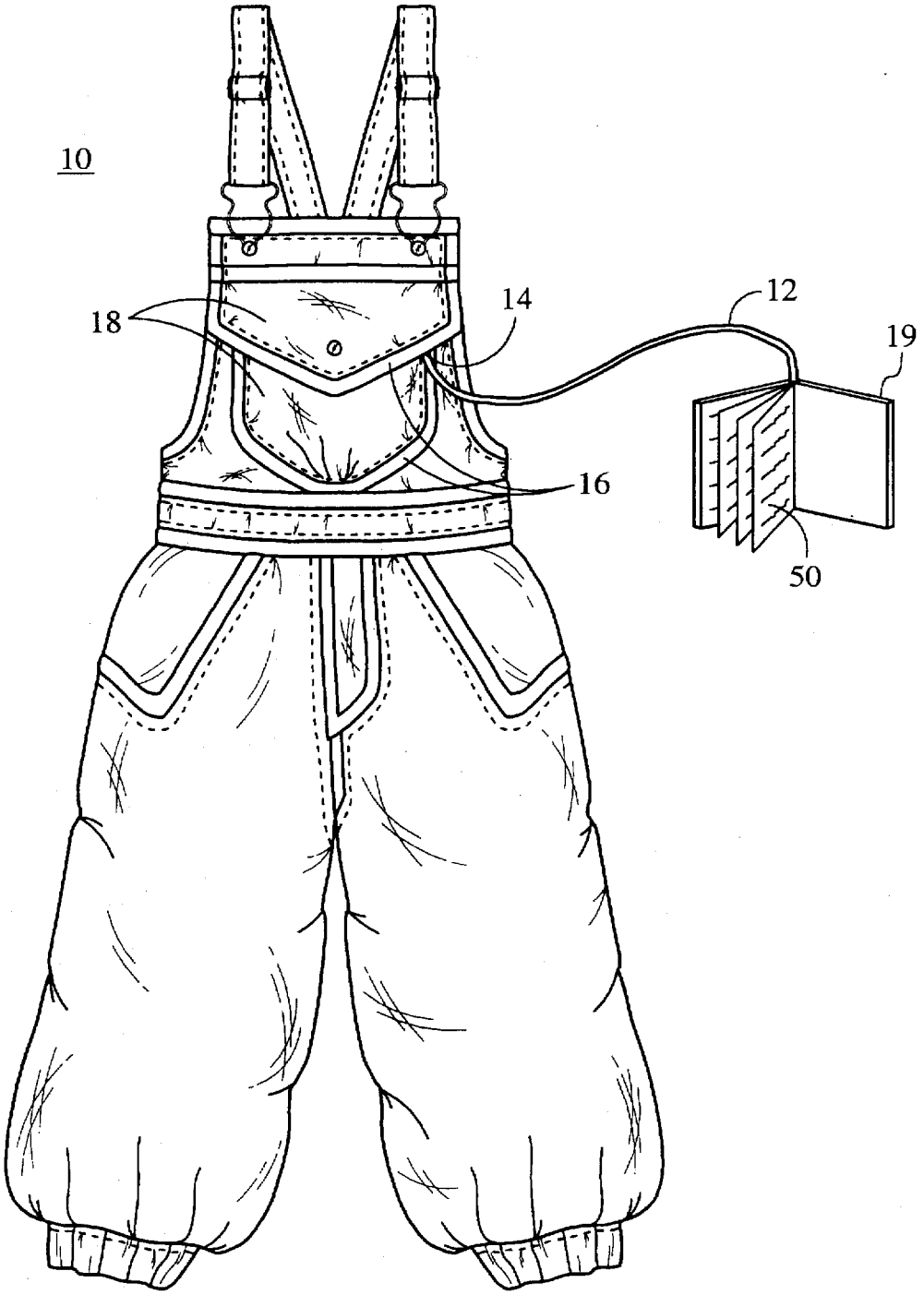
FIG. 1 is front view of a first garment (overalls) in accordance with the present invention.
Figure 2:
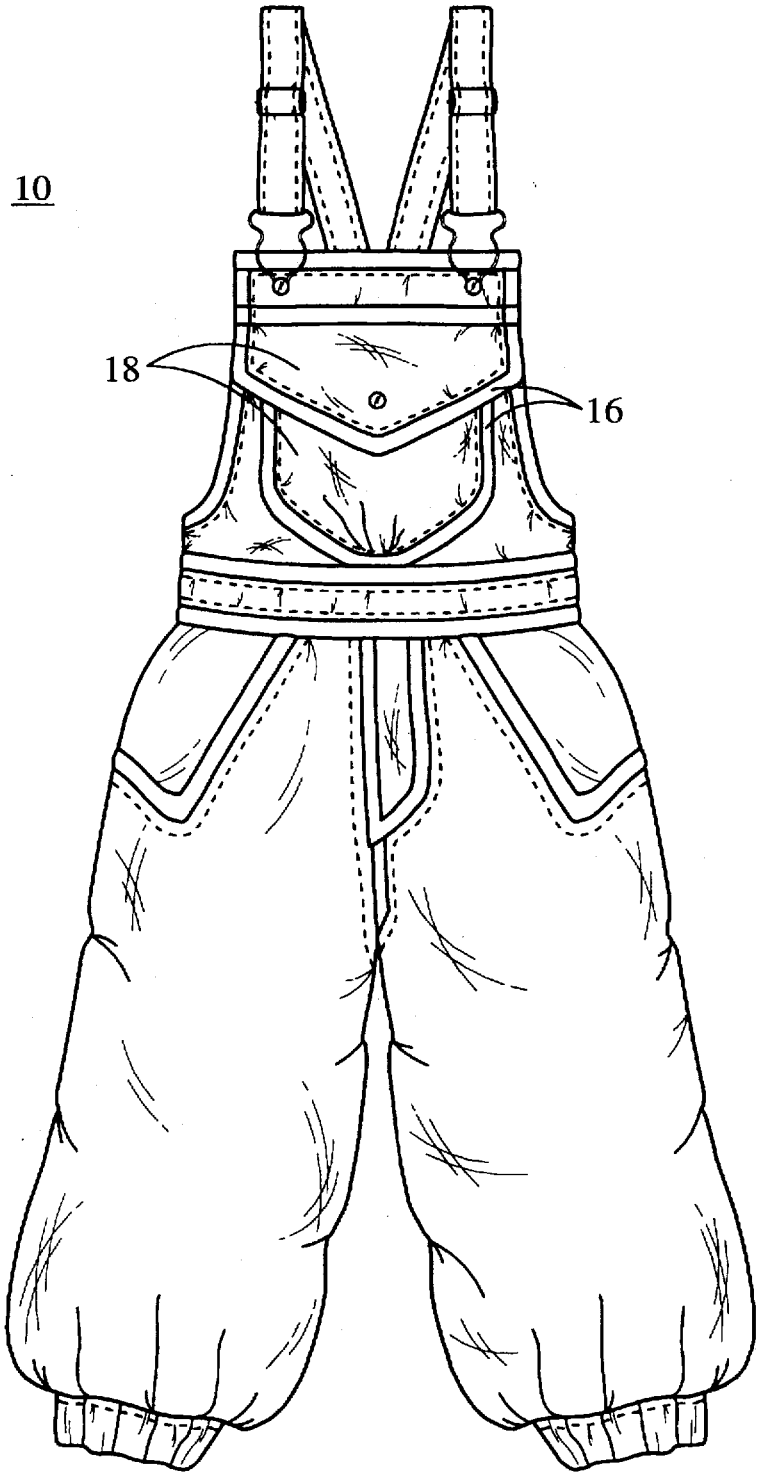
FIG. 2 is a front view of the overalls of FIG. 1 showing book inside pocket with flap on pocket closed.

Referring now to FIG. 1, what is shown is a front view of a first embodiment of a garment in accordance with the present invention. The garment 10 is an overall 10 which includes a string 12 attached to an inside corner 14 of a front pocket 16 including a flap portion 18. The string 12 is attached to a cover portion 19 which covers a book 50. As can be seen in FIG. 2, reading material such as a book 50 itself can be put directly inside the front pocket 16, due to the string being attached thereto. The book 50 can then be placed inside the pocket 16 and taken out of pocket 16. The flap portion 18 can then be extended over the book 50 as shown in FIG. 2.

Figure 3:
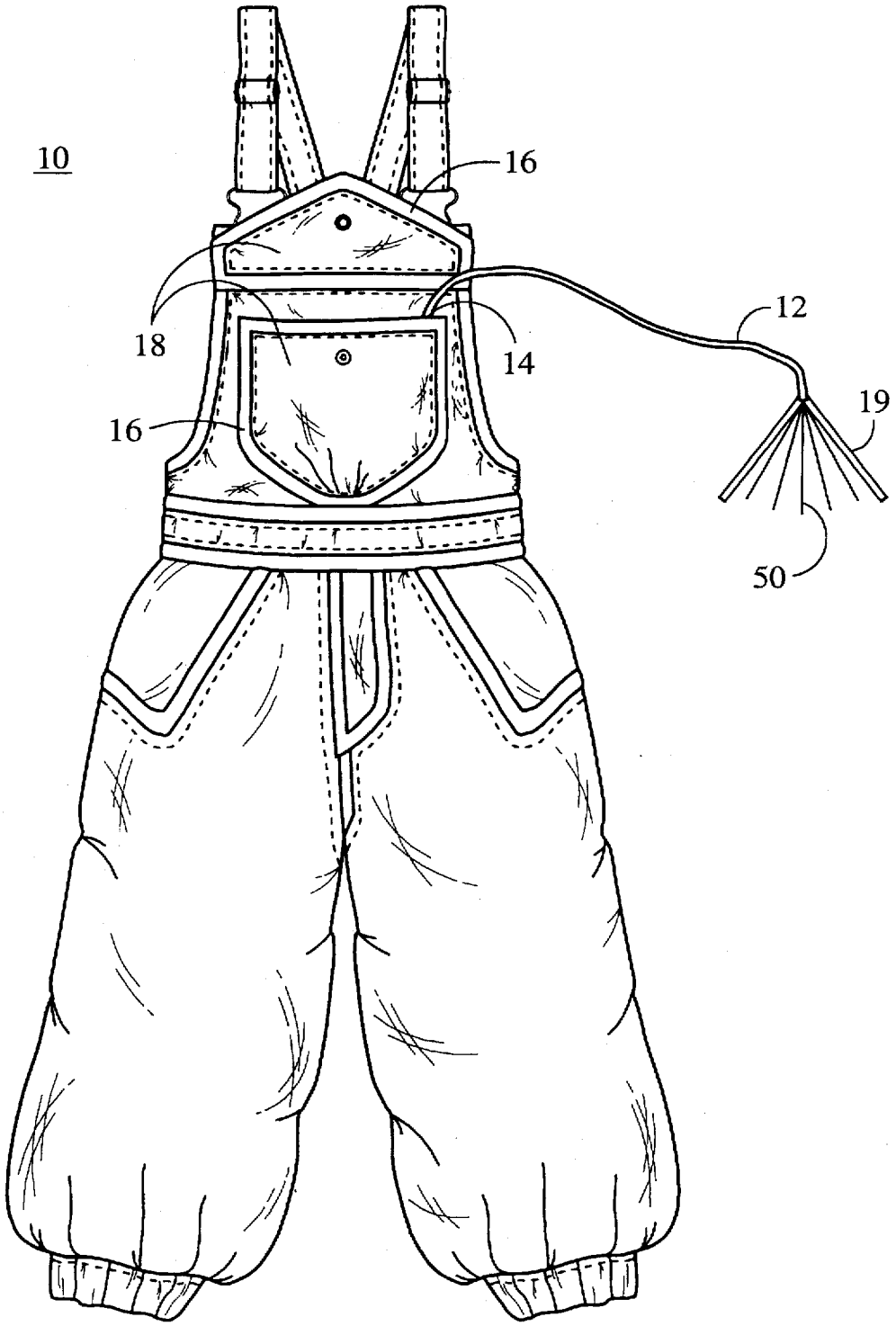
FIG. 3 is a front view of the overalls of FIG. 1 showing open flap on pocket with book extended from pocket showing the top view of opened book.
Figure 4:
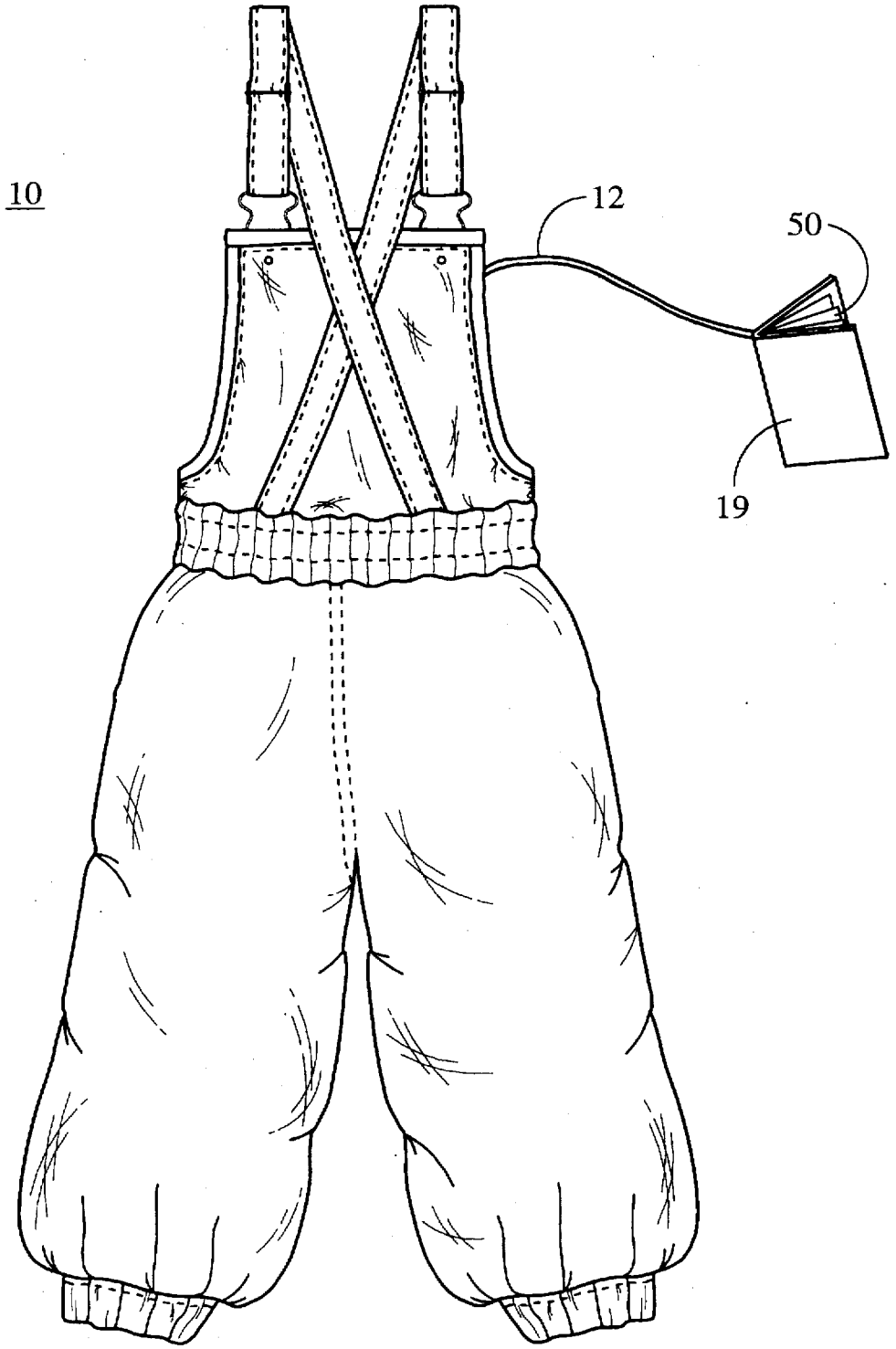
FIG. 4 is a back view of the overalls of FIG. 1 showing book extended from front pocket slightly opened front view of book.
Figure 5:
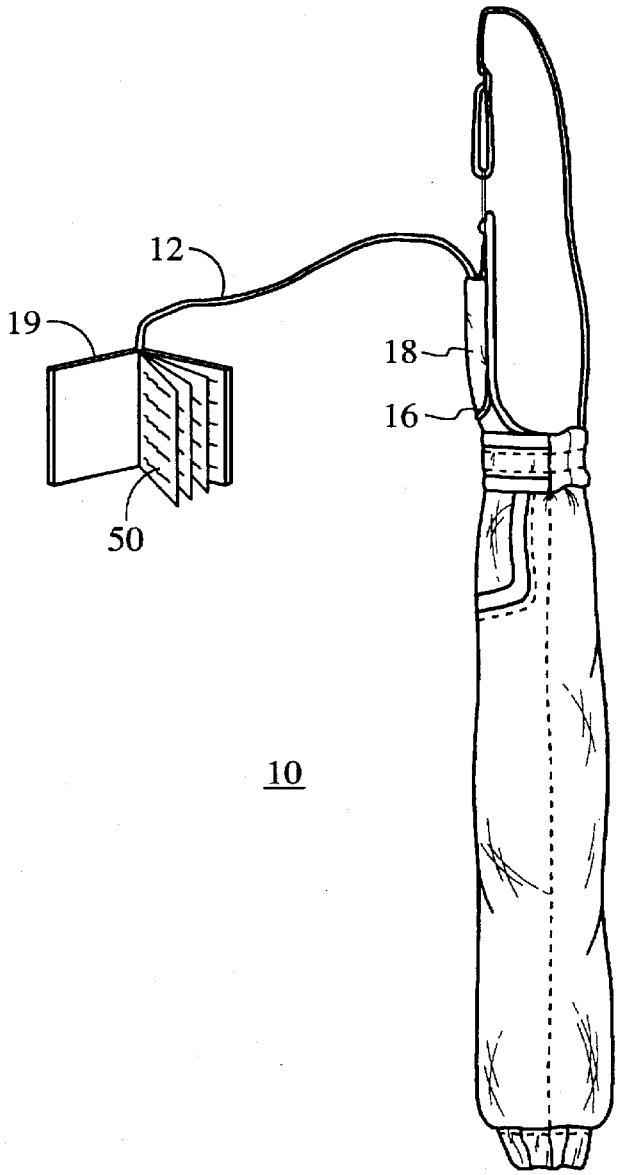
FIG. 5 is a side view of the overalls of FIG. 1 showing flap on pocket closed showing book extended from pocket, showing the opened back cover of book.

Referring now to FIG. 3, what is shown is a front view of the overalls 10 of FIG. 1 showing an open flap portion 18 on the pocket 16 with a book 50 extended from the pocket 16 showing the top view of opened book 50. FIG. 4 is shown is a back view of the overalls 10 of FIG. 1 showing the book 50 extended from front pocket 16 slightly opened front view of book 50. FIG. 5 is a side view of the overalls 10 of FIG. 1 showing flap portion 18 on the pocket 16 closed showing the book 50 extended from the pocket 16, showing the opened back cover of the book 50.

Figure 10:
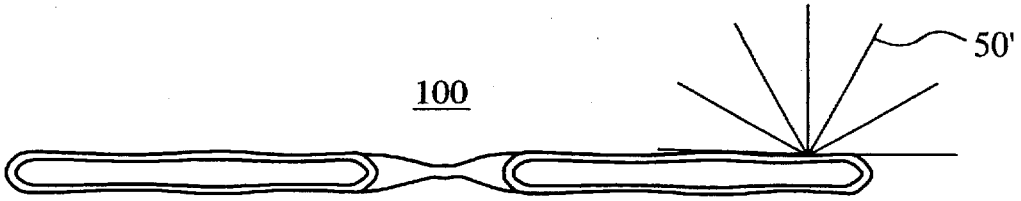
FIG. 10 is the bottom view of the shorts of FIG. 6 showing the bottom open view of the book.
Figure 6:
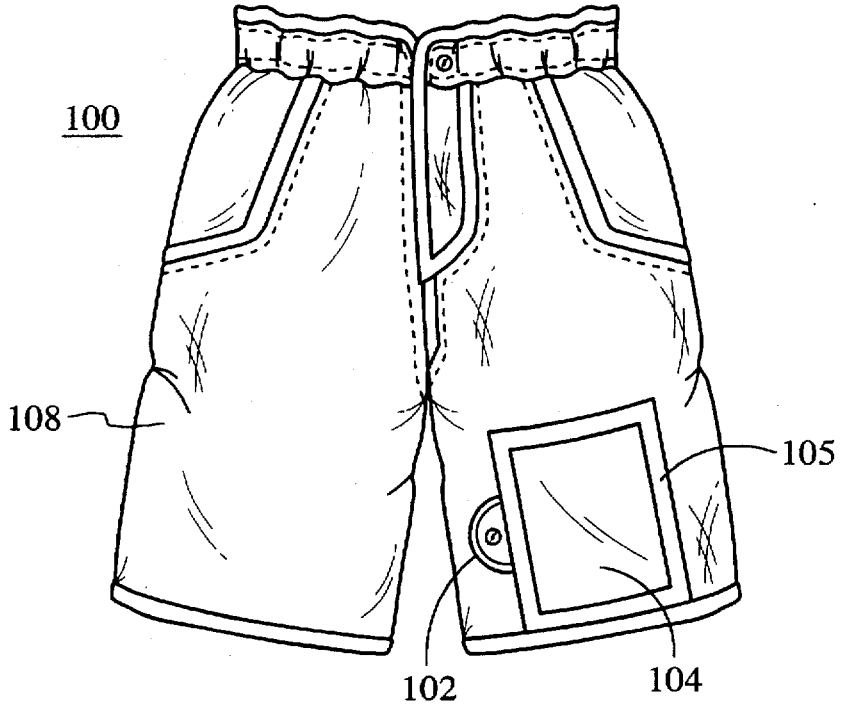
FIG. 6 is a front view of a second embodiment of a garment (shorts) including a book made of fabric in accordance with the present invention.
Figure 7:
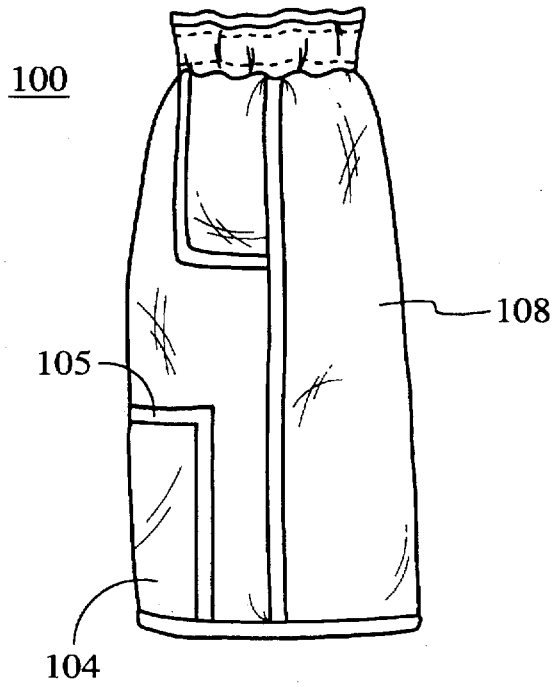
FIG. 7 is a side view of the shorts of FIG. 6 showing the book closed.
Figure 8:
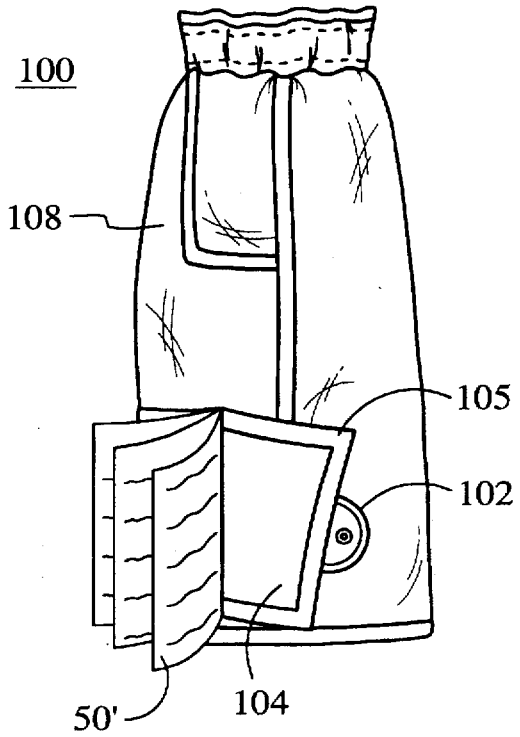
FIG. 8 is a side view of the shorts of FIG. 6 showing the book opened.
Figure 9:
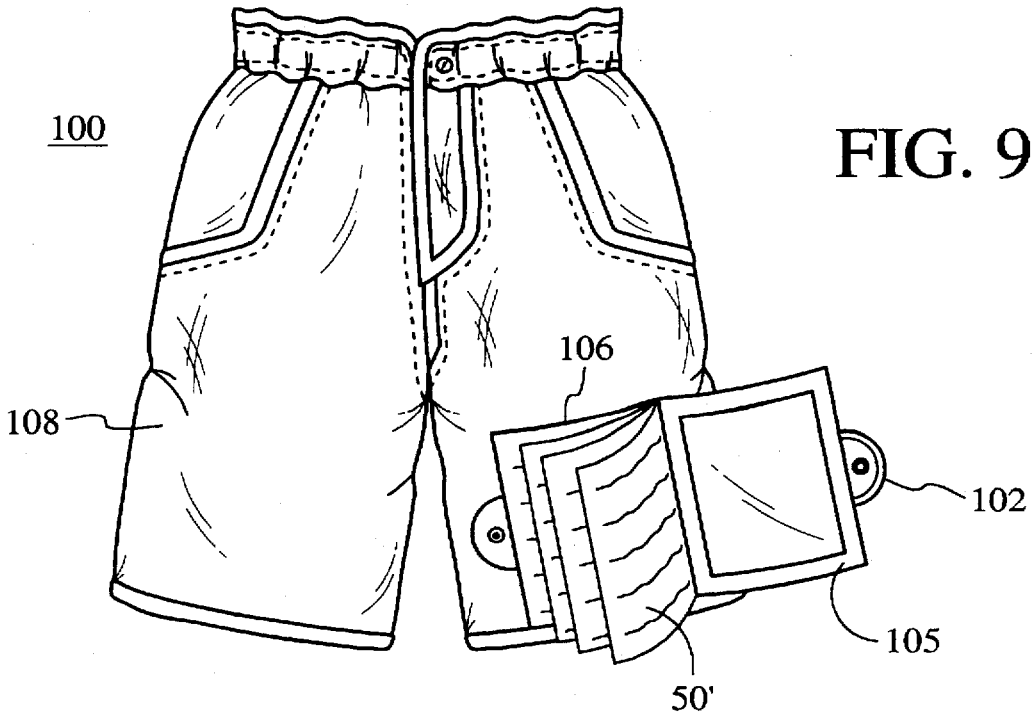
FIG. 9 is a front view of the shorts of FIG. 6 showing the book opened.

Referring now to FIG. 6, what is shown is a front view of a second embodiment of a garment in accordance with the present invention. The garment are shorts 100. The back cover 106 of a book 50' can be sewn onto a leg 103 of the shorts 100 via an attachment portion. The book 50' can then be read by a child or the like when sitting. The book 50' can be opened and closed. The front cover 104 adaptably engages the body portion 108 of the shorts via a snap member 102 located on the flap portion 105 in order to close and seal the book. FIG. 7 shows a side view of the shorts 100 of FIG. 6 showing the book 50' closed. FIG. 8 shows a side view of the shorts 100 of FIG. 6 showing the book 50' opened. FIG. 9 is a front view of the shorts 100 of FIG. 6 showing the book 50' opened. FIG. 10 shows the bottom view of the shorts 100 of FIG. 6 showing the bottom open view of the book 50'.

Although the present invention has been described in accordance with the embodiments shown, one of ordinary skill in the art will recognize that there could be variations to those embodiments and those variations would be within the spirit and scope of the present invention.

It should be understood that although this garment has been illustrated as shorts and overalls, any type of children's garment could be utilized in accordance with the present invention and that use would be within the spirit and scope of the present invention. For example, a skirt, pants or the like could be utilized as the garment and that use would be within the spirit and scope of the present invention. In addition, many types of devices could be utilized to attach the book or reading material to the garment, including but not limited to hook and loop fasteners, velcro fasteners, zippers and buttons, and their use would be within the spirit and scope of the present invention.

Accordingly, many modifications may be made by one of ordinary skill in the art without departing from the spirit and scope of present invention, the scope of which is defined solely by the appended claims.

I claim:

1. Shorts including a book member to be worn by a child comprising:

a body portion including two leg portions;

a book member with an attachment portion coupled thereto located on one of the leg portions of the shorts for retaining the book member to the shorts;

a flap portion coupled to the shorts adjacent said book member;

a snap member component located on the flap member and a corresponding snap member component located on said body portion adjacent said book member wherein upon connection of said snap member components the book member is held in a closed position when the book member is not in use.

2. The shorts of claim 1 in which the attachment portion comprises a string member.

3. The shorts of claim 1 in which the attachment portion comprises sewing the book member to one of the leg portions of the shorts.

4. Overalls including a book member to be worn by a child comprising:

a body portion including two leg portions;

a book member with an attachment portion coupled thereto located on one of the leg portions of the shorts for retaining the book member to the overalls;

a flap portion coupled to the body portion adjacent said book member;

a snap member component located on the flap member and a corresponding snap member component located on said body portion adjacent said book member wherein upon connection of said snap member components the book member is held in a closed position when the book member is not in use.

5. The overalls of claim 4 in which the attachment portion comprises a string member.

6. The overalls of claim 4 in which the attachment portion comprises sewing the book member to one of the leg portions of the overalls.

7. A garment including a book member comprising:

a body portion;

a book member with an attachment portion coupled thereto located on the body portion of the garment for retaining the book member to the garment;

a flap portion coupled to the body portion adjacent said book member;

a snap member component located on the flap member and a corresponding snap member component located on said body portion adjacent said book member wherein upon connection of said snap member components the book member is held in a closed position when the book member is not in use.

8. The garment of claim 7 in which the garment comprises pants.

9. The garment of claim 7 in which the garment comprises a skirt.

* * * * *